US006068057A

United States Patent [19]

Beukema

[11] Patent Number: 6,068,057

[45] Date of Patent: May 30, 2000

[54] DRY PIPE VALVE SYSTEM

[75] Inventor: John A. Beukema, Somers, N.Y.

[73] Assignee: Reliable Automatic Sprinkler Co., Inc., Mt. Vernon, N.Y.

[21] Appl. No.: 09/271,578

[22] Filed: Mar. 18, 1999

Related U.S. Application Data

[63] Continuation-in-part of application No. 09/079,574, May 15, 1998.

[51] Int. Cl.[7] ..... A62C 37/36

[52] U.S. Cl. ..... 169/22; 169/17; 169/20

[58] Field of Search ..... 169/19, 20, 21, 169/22, 23, 17

[56] References Cited

U.S. PATENT DOCUMENTS

| | | | |
|---|---|---|---|
| 909,985 | 1/1909 | Buell | 169/22 |
| 1,790,467 | 1/1931 | Griffith | 169/22 |
| 1,796,201 | 3/1931 | Heinsman | 169/22 |
| 3,307,633 | 3/1967 | Newall | 169/19 |
| 3,464,497 | 9/1969 | Globerman et al. | 169/22 |
| 3,587,746 | 6/1971 | Venison | 169/20 |
| 4,085,765 | 4/1978 | Nelson | 169/19 |

*Primary Examiner*—Kevin Weldon
*Assistant Examiner*—Jorge Bocanegra
*Attorney, Agent, or Firm*—Baker Botts, LLP

[57] ABSTRACT

In the dry pipe sprinkler valve arrangement disclosed in the specification, a dry pipe sprinkler line is normally supplied with air at a pressure in a range from about 5 psi to about 20 psi and is connected through a check valve, a dry pipe valve and a manual control valve to a water supply line. The dry pipe valve has a clapper which is normally retained in the closed position by a latch member. An actuating valve having a diaphragm which receives air pressure from the sprinkler line on one side and engages an orifice to which water from the water supply is applied on the other side permits the latch member to release the clapper when the air pressure falls as a result of opening of a sprinkler in the sprinkler line. When the system is being reset after operation the latch is either automatically movable or manually movable by an external handle to restore the clapper to its seated position without requiring opening of the dry pipe valve housing.

7 Claims, 3 Drawing Sheets

DRY PIPE VALVE SYSTEM

REFERENCE TO RELATED APPLICATION

This application is a continuation-in-part of my copending application Ser. No. 09/079,574 filed May 15, 1998.

BACKGROUND OF THE INVENTION

This invention relates to dry pipe valve fire protection sprinkler systems in which the lines leading to the sprinklers are normally isolated from a source of water under pressure by a dry pipe valve which is released in response to detection of a fire hazard.

A conventional dry pipe valve system is disclosed in the Juliano U.S. Pat. No. 3,589,445, the disclosure of which is incorporated herein by reference. In such systems, a plurality of sprinkler heads are mounted on a sprinkler pipe which normally contains air under pressure and which is isolated from a water pipe containing water under pressure by a dry pipe valve. When a sprinkler head is actuated by an ambient temperature above the release temperature of the valve, the dry pipe valve opens and allows the water to flow to the sprinklers. In order to open the dry pipe valve in a more timely manner, an accelerator valve responsive to the pressure drop in the sprinkler pipe is opened to apply air pressure to an intermediate chamber in the dry pipe valve so as to increase the pressure tending to open the dry pipe valve. Conventionally, the air pressure normally applied to the sprinkler line, and to the intermediate chamber when the accelerator is actuated, is at least 20 psi to about 50 psi and the air/water trip ratio, i.e. the ratio between the air pressure in the dry pipe line and the water pressure applied to the dry pipe valve which is required to open the dry pipe valve when the air pressure drops, is about 1:6. When the dry pipe valve has been opened, the valve clapper is latched in the open position and, in order to reset the dry pipe valve, the valve housing must be opened and the clapper must be unlatched manually. In such conventional dry pipe valve systems, the dry pipe valve housing contains several inches of priming water above the valve clapper to aid the sealing process and to preserve the rubber gasket in the valve from detrimental effects produced by the high levels of oxygen in the high pressure air in the dry pipe line.

The Meyer et al. U.S. Pat. Nos. 5,295,503 and 5,439,028 disclose a sprinkler pipe valve which is convertible between a wet configuration and a dry configuration. That valve includes a clapper and a control mechanism for positioning the clapper. In one position, the control mechanism latches the clapper in the closed position to seal the water line from the dry pipe and then permit release of the clapper when the system pressure, which is normally maintained at about 20 psi, drops to a selected level, such as about 15 psi, so as to permit the water to fill the sprinkler line. In this system, the control for the clapper release mechanism utilizes a spool valve which receives the system air pressure at one end and has a balancing spring at the other end so that, when the system pressure drops below the selected value, the valve spool moves in such a way as to release the mechanism that retains the clapper in position. This control mechanism can also reset the clapper to the closed position without requiring the valve housing to be opened. Moreover, when the system has been reset and the valve clapper is closed, all of the water is drained from the valve housing so that no priming water is present above the clapper.

SUMMARY OF THE INVENTION

Accordingly, it is an object of the present invention to provide a dry pipe valve system which overcomes disadvantages of the prior art.

Another object of the invention is to provide a dry pipe valve system which does not require priming water above the clapper.

A further object of the invention is to provide a dry pipe valve system in which only a low pneumatic pressure in the sprinkler system is required to keep the dry pipe valve closed and in which the dry pipe valve clapper is externally resettable.

These and other objects of the invention are attained by providing a dry pipe valve system with a dry pipe valve and with an actuating valve having a diaphragm which engages a reduced diameter orifice so as to provide a very low air/water pressure trip ratio, thereby permitting a low air pressure in the system and eliminating the need for priming water above the clapper of the dry pipe valve. In a preferred embodiment, the air/water pressure trip ratio is in the range from about 1:10 to 1:20 so that the pneumatic pressure required to keep the dry pipe valve closed is in a range from about 5 psi to about 20 psi. With such low pressures, the need for maintaining priming water above the clapper in the dry pipe valve to preserve a rubber seal from detrimental effects of high oxygen levels at high air pressure is eliminated. Furthermore, the dry pipe valve includes an externally resettable latch for holding the dry pipe valve clapper in either the closed position or the open position. This provides positive assurance against inadvertent opening of the valve in response to pressure surges in the water supply line while avoiding the need to open the valve to reset the clapper. A preferred embodiment of the invention also includes a common drain manifold to collect and carry away water from the sprinkler line, the dry pipe valve and the actuating valve when the system is reset after testing or use.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
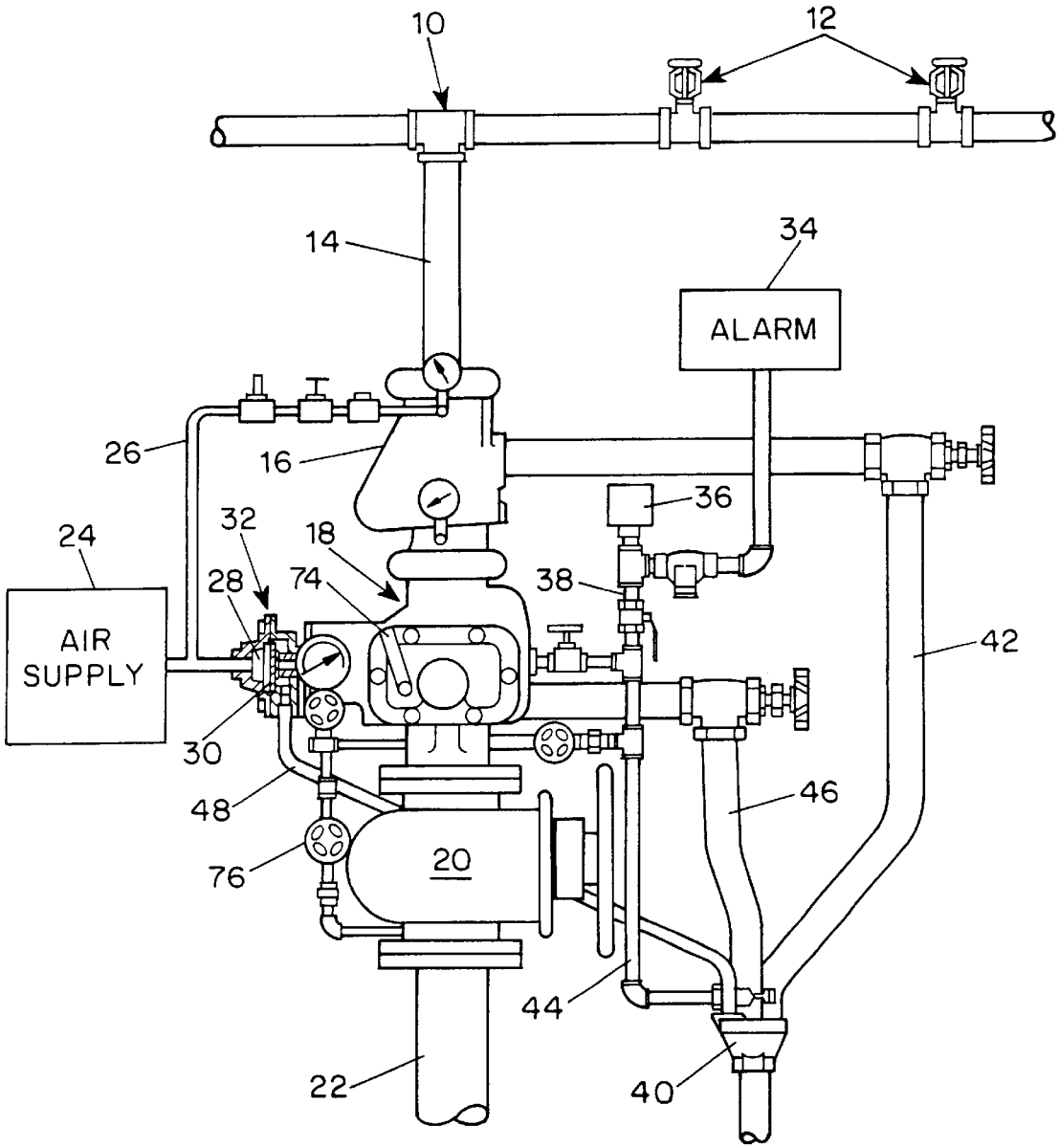
FIG. 1 is a schematic diagram illustrating a representative embodiment of a dry pipe valve system arranged according to the invention.

In the typical embodiment of the invention shown in FIG. 1, a fire protection sprinkler system includes a sprinkler line 10 in which a plurality of sprinklers 12 are mounted and positioned to spray a fire-extinguishing fluid such as water over a region to be protected from fire. The sprinkler line 10 is connected through a riser 14, a check valve 16, a dry pipe valve 18 and a manually operated main control valve 20 to a water supply line 22, the check valve 16 being oriented to prevent fluid flow from the sprinkler line 10 and the riser 14 to the dry pipe valve 18.

In order to pressurize the dry pipe sprinkler line 10, an air supply 24 supplies air at a pressure of about 5 psi to 20 psi, preferably 10 psi to 15 psi, to an air line 26 leading to the riser 14 and also to a chamber 28 on one side of a diaphragm 30 in an actuating valve 32 to be described in greater detail hereinafter. A mechanical alarm 34 and a pressure sensor 36 are connected through a line 38 to the dry pipe valve 18 and are arranged to respond to the water pressure applied to the line 38 when the dry pipe valve has been opened to supply water to the sprinkler line 10. In order to drain water from the dry pipe system after it has been operated or tested, a common manifold 40 is connected to a drain line 42 from the check valve 16, a drain line 44 from the alarm and pressure sensor line 38, a drain line 46 from the dry pipe valve 18 and a drain line 48 from the actuating valve 32, some of the drain lines requiring a manual control valve to open and close the connection to the manifold 40.

Figure 2:
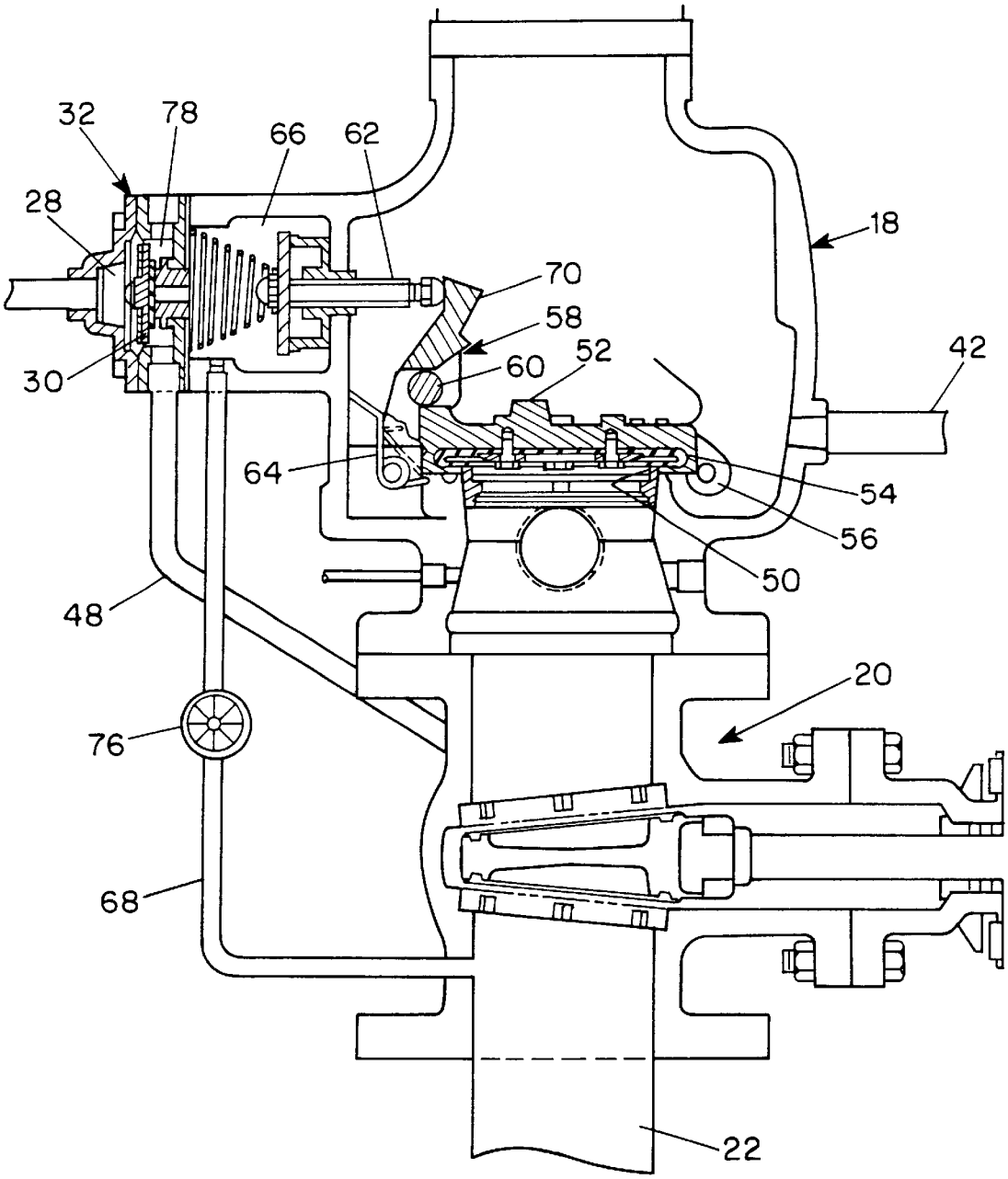
FIG. 2 is a cross-sectional view showing the arrangement of a representative dry pipe valve and actuating valve for use in the system shown in FIG. 1.

The dry pipe valve 18 and the actuating valve 32 are shown separately in FIG. 1 and combined in the cross-sectional illustration of FIG. 2. The main control valve 20 supplies water to an inlet opening 50 in the lower part of the dry pipe valve which is normally closed by a clapper 52 having a rubber gasket 54 which engages the inlet opening, the clapper being pivotably supported on the right hand side as viewed in FIG. 2 by a hinge 56. To hold the clapper 52 in the inlet-sealing position as illustrated in FIG. 2 against the pressure of the water in the supply line 22, a latch lever 58, which is pivotally mounted on the left side of the inlet opening as seen in FIG. 2, has a stop member 60 which engages the top of the clapper 52, as long as the latch lever 58 is held in the illustrated position by a push rod 62. The push rod 62 extends into a chamber 66 to which water pressure from the supply line 22 is supplied by a line 68. The latch lever 58 is biased by a spring 64 in the clockwise direction as viewed in FIG. 2 to position the stop member 60 over the clapper 52. The latch lever readily pivots counter-clockwise when it is intended to release the clapper from the stop member 60, permitting water from the supply line 22 to force the clapper open and pass through the dry pipe valve 18 and the check valve 16 to the sprinklers 12 in the line 10. Whenever the water pressure in the chamber 66 is reduced sufficiently, any significant holding force acting through the push rod 62 against the latch lever 58 and consequently on the stop member 60 is eliminated, thereby allowing the clapper 52 to be forced open by the water pressure in the supply line 22.

When the ambient temperature at one of the sprinklers 12 exceeds the sprinkler release temperature, the sprinkler is opened, causing the air pressure in the lines 10, 14 and 26 to fall, which reduces the pressure in the chamber 28 on the opposite side of the diaphragm 30 in the actuating valve 32 that is in communication with the chamber 66. When the air pressure in the chamber 28 is normally maintained at about 15 psi, a pressure drop to a selected lower level, such as 5 psi, i.e. about 1/15 of the normal water pressure of about 75 psi, causes the diaphragm 30 to move to the left as seen in FIG. 2, opening the actuating valve 32, thereby reducing the water pressure in the chamber 66. This reduces the force acting through the push rod 62 and the latch lever 58 to a level that permits release of the clapper 52 to open the dry pipe valve 20, thereby supplying water under pressure to the lines 10 and 14 and the sprinklers 12. In view of the low air pressure in the system, the need for an accelerator to facilitate opening of the clapper 58 is reduced.

After the fire has been extinguished, the main valve 20 is closed manually to shut off the water supply and the clapper 52 moves from its fully open position to rest against a stop 70 on the latch lever 58. To restore the dry pipe system to its normal condition, the drain line valves are opened manually and water is drained from the sprinkler lines 10 and 14 through the drain line 42, from the alarm line 38 through the drain line 44, from the dry pipe valve 18 through the drain line 46, and from the actuating valve 32 through the drain line 48, all of which lead to the common manifold 40. When the system has been drained and the drain line valves have been closed, the latch lever 58 is rotated in the counter-clockwise direction by an external handle 74, shown in FIG. 1, to reseat the clapper 52 and restore it to its sealing position shown in FIG. 2, after which the latch lever is moved clockwise to its latching position on the clapper 52 by the spring member 64 as shown in FIG. 2. The valve 76 is then opened to supply water pressure to the chamber 66 which restores the holding force on the latch lever 58. When all of the sprinklers 12 which were activated have been replaced and the lines 10, 14 and 26 and the actuating valve air chamber 28 have been repressurized from the air supply 24, the main control valve 20 is opened to restore the system to its ready condition.

Figure 3:
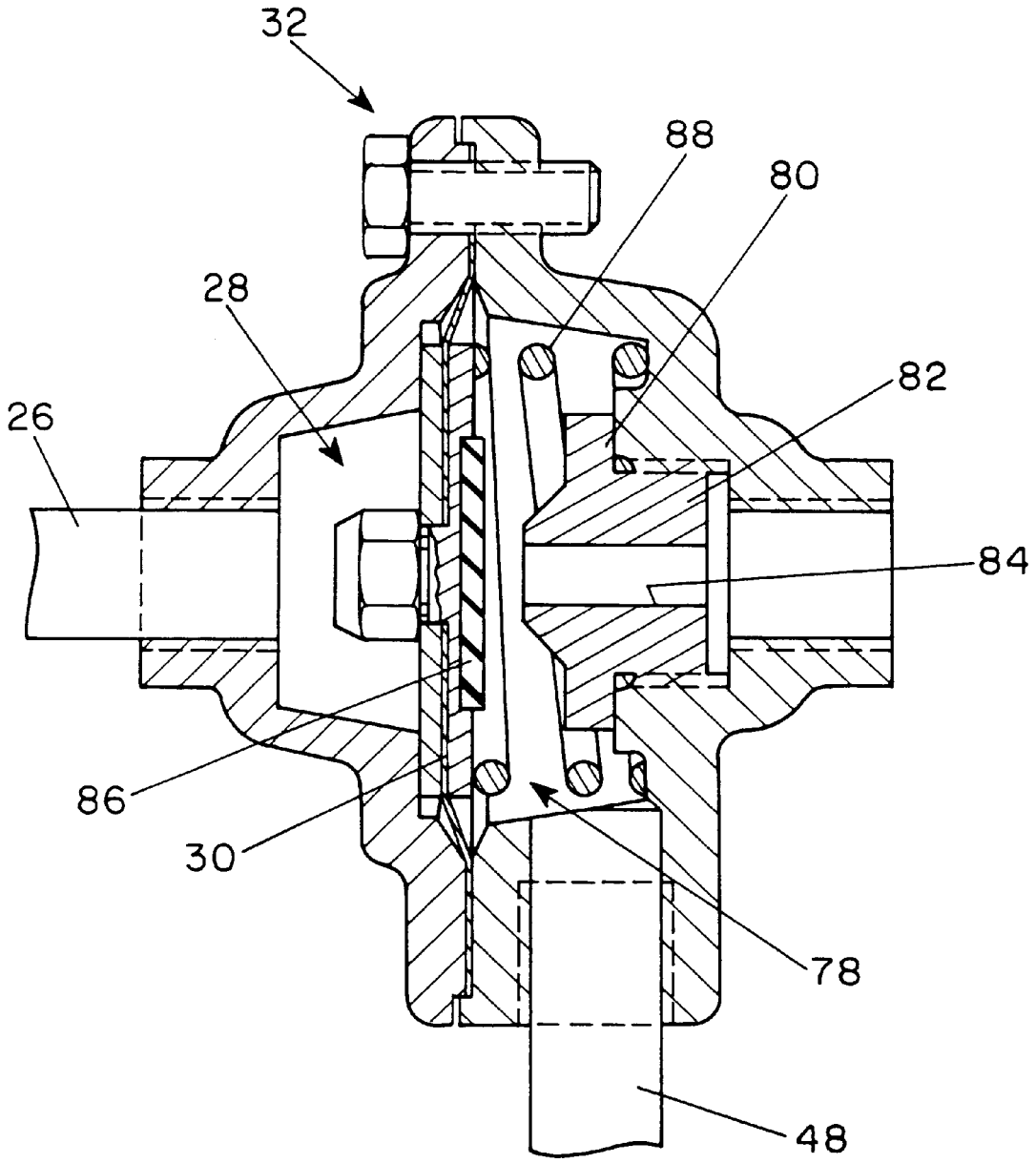
FIG. 3 is a cross-sectional view showing the actuating valve of FIG. 2 in greater detail.

In order to enable the system to respond to a small pressure drop from a normal low level of about 15 psi to a reduced pressure level of about 5 psi when a sprinkler is actuated by elevated temperature, the diaphragm 30 in the actuating valve 32, as shown in detail in FIG. 3, separates the air chamber 28, which receives air at the pressure of the sprinkler line, from a chamber 78 which communicates with the chamber 66 connected to the water supply line 22 when the diaphragm 30 is in the left hand position shown in FIG. 3. An insert 82 in the passage leading from the chamber 66 to the chamber 78 is formed with a central opening 84 which has a diameter approximately 1/10 to 1/25, and preferably about 1/15 to 1/20, of the diameter presented by the diaphragm 30 to the air pressure in the chamber 28. Consequently, when the chamber 28 has been pressurized with sufficient air from the air supply 24 while water is being supplied to the chamber 66, a resilient pad 86 on one side of the diaphragm 30 is moved against the open end of the passage 84 and is held there with a force which exceeds the force applied by the water when it is supplied through the opening 84 from the chamber 66. As a result, the push rod 62 is normally retained in the position holding the latch lever 58 in its latching position.

Because of the high ratio of the diaphragm area exposed to the chamber 28 to the cross-sectional area of the opening 84, the actuating valve 32 remains closed even though the air pressure is maintained in a low range from about 5 psi to about 20 psi. Consequently the actuating valve will respond to a relatively small reduction in pressure, of between 5 and 10 psi, when a sprinkler is opened to open the actuating valve and thereby actuate the dry pipe valve. Depending on the performance characteristics desired, a spring 88 in the chamber 78 may be used to urge the diaphragm 30 away from the orifice 84 to facilitate opening of the actuating valve when the pressure in the chamber 28 falls below a selected level. Moreover, the low air pressure in the system permits timely opening of the dry pipe valve reducing the need for an accelerator which is conventionally required to hasten the opening of the dry pipe valve to fill the sprinkler line with water.

In an alternative embodiment of the invention, the clapper 52 may be reseated automatically rather than with an external handle 74. In this embodiment, the biasing spring 64 and the stop 70 on the latch lever 58 are eliminated and the latch lever remains in its extreme counterclockwise position after opening of the clapper 52. Subsequently, closing of the control valve 20 to stop water from flowing into the pipes 10 and 14 allows the clapper to automatically rotate counter-clockwise past the latching lever until it is reseated against the inlet opening 50. Restoration of the water pressure in the chamber 66 as previously described will restore the holding force against the latch lever 58 to retain the stop member 60 against the clapper 52.

Although the invention has been described herein with reference to specific embodiments, many modifications and variations therein will readily occur to those skilled in the art. Accordingly, all such variations and modifications are included within the intended scope of the invention.

I claim:

1. A dry pipe sprinkler valve arrangement comprising:

a sprinkler line containing sprinklers through which water is to be distributed over an area to be protected in the event of a fire hazard;

a dry pipe valve connected to a water supply line and adapted to be opened to supply water under pressure to the sprinkler line;

an air supply for supplying air under pressure to the sprinkler line; and an actuating valve responsive to a reduction in the air pressure in the sprinkler line to release the dry pipe valve and permit water to be supplied from the water supply line through the dry pipe valve to the sprinkler line;

wherein the actuating valve includes a diaphragm subjected on one side to air at a pressure corresponding to the air pressure in the sprinkler line and, on the other side, normally engaging an orifice connected to the water supply line, and wherein the ratio of the diameter of the orifice to the diameter of the diaphragm subjected to the air pressure in the sprinkler line is in the range from about 1:10 to about 1:25.

2. A dry pipe sprinkler valve arrangement according to claim 1 wherein the ratio of the diameter of the orifice to the diameter of the diaphragm subjected to the air pressure in the sprinkler line is in the range of about 1:15 to about 1:20.

3. A dry pipe sprinkler valve arrangement according to claim 1 wherein the dry pipe valve includes a clapper and a latch arrangement normally retaining the clapper in the closed position and holding the clapper in an open position after the dry pipe valve has been opened, and including an external reset arrangement by which the latch may be moved to permit the clapper to return to the closed position without opening the dry pipe valve housing.

4. A dry pipe sprinkler valve arrangement according to claim 1 wherein the air supply supplies air at pressure in the range from about 5 psi to about 20 psi to the sprinkler line.

5. A dry pipe sprinkler valve arrangement according to claim 1 wherein the actuating valve includes a spring urging the diaphragm away from the orifice connected to the water supply line.

6. A dry pipe sprinkler valve arrangement according to claim 1 including:

an alarm line connected to the dry pipe valve to receive water to actuate an alarm when the dry pipe valve is open;

a check valve between the dry pipe valve and the sprinkler line to prevent fluid from the sprinkler line from flowing to the dry pipe valve;

a drain manifold; and separate drains from the dry pipe valve, the check valve, the alarm line and a valve actuator leading to the drain manifold to provide a common drain for the dry pipe sprinkler valve arrangement.

7. A dry pipe sprinkler valve arrangement according to claim 1 wherein the dry pipe valve includes a clapper and a latch arrangement normally holding the clapper in the closed position and responsive to operation of the actuating valve to permit the clapper to move to the open position and wherein the latch arrangement permits automatic return of the clapper to the closed position upon cessation of water flow through the dry pipe valve.

* * * * *